US005769001A

United States Patent [19]

Viessmann

[11] Patent Number: 5,769,001

[45] Date of Patent: Jun. 23, 1998

[54] LOAD-CARRYING PALLET

[76] Inventor: Hans Viessmann, Schlosstrasse 3, D-95030 Hof, Germany

[21] Appl. No.: 586,657

[22] PCT Filed: Apr. 28, 1995

[86] PCT No.: PCT/DE95/00571

§ 371 Date: Dec. 27, 1995

§ 102(e) Date: Dec. 27, 1995

[87] PCT Pub. No.: WO95/30587

PCT Pub. Date: Nov. 16, 1995

[30] Foreign Application Priority Data

May 4, 1994 [DE] Germany ..... 44 15 698.7
Mar. 7, 1995 [DE] Germany ..... 195 08 009.2

[51] Int. Cl.[6] ..... B65D 19/00

[52] U.S. Cl. ..... 108/51.3; 108/901

[58] Field of Search ..... 108/51.3, 51.1, 108/901, 902

[56] References Cited

U.S. PATENT DOCUMENTS

| | | | |
|---|---|---|---|
| 867,389 | 10/1907 | Lorenz . | |
| 3,228,358 | 1/1966 | Sepe et al. | 108/901 X |
| 3,330,228 | 7/1967 | Donnelly . | |
| 3,630,157 | 12/1971 | Ortenblad | 108/901 X |
| 4,467,728 | 8/1984 | Horne | 108/51.3 X |
| 4,606,278 | 8/1986 | Shuert | 108/901 X |
| 4,674,414 | 6/1987 | Nulle et al. | 108/901 X |
| 4,790,966 | 12/1988 | Sandberg et al. | 108/901 X |
| 4,879,956 | 11/1989 | Shuert . | |

FOREIGN PATENT DOCUMENTS

| | | |
|---|---|---|
| 0616076 | 9/1994 | European Pat. Off. . |
| 1360661 | 3/1964 | France . |
| 2087654 | 12/1971 | France . |
| 73 03 502 | 5/1973 | Germany . |
| 29 18 573 | 4/1989 | Germany . |
| 91 00 014 | 5/1991 | Germany . |
| 94 13 164 | 12/1994 | Germany . |

*Primary Examiner*—Jose V. Chen
*Attorney, Agent, or Firm*—Collard & Roe, P.C.

[57] ABSTRACT

A load transporting pallet made of paper, cardboard and/or cellulose fiber waste is disclosed. In order to improve the carrying capacity of such pallets, a supplementary reinforcement layer made of recyclable material is arranged between both layers that form the carrying surface and the mounting fee. The reinforcement layer is provided with passages distributed throughout its whole surface and through which the top and bottom layers are interconnected by their opposite rough surfaces.

9 Claims, 6 Drawing Sheets

Fig.1
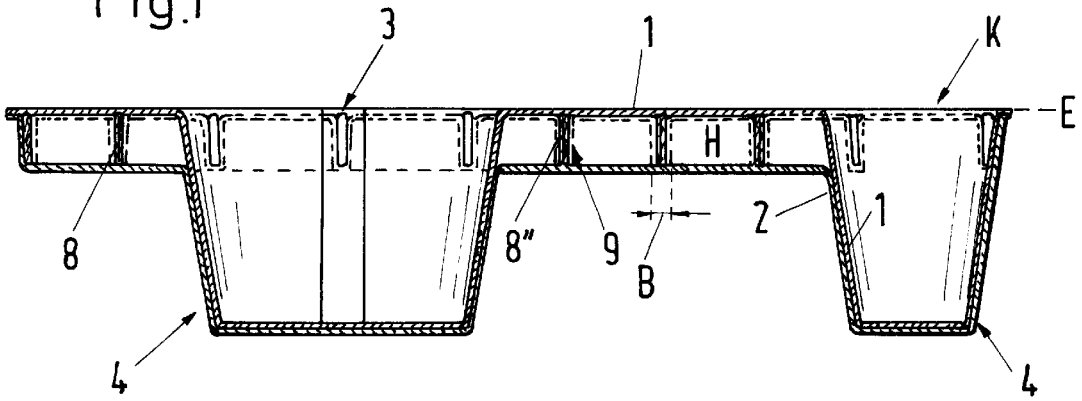
Fig.2
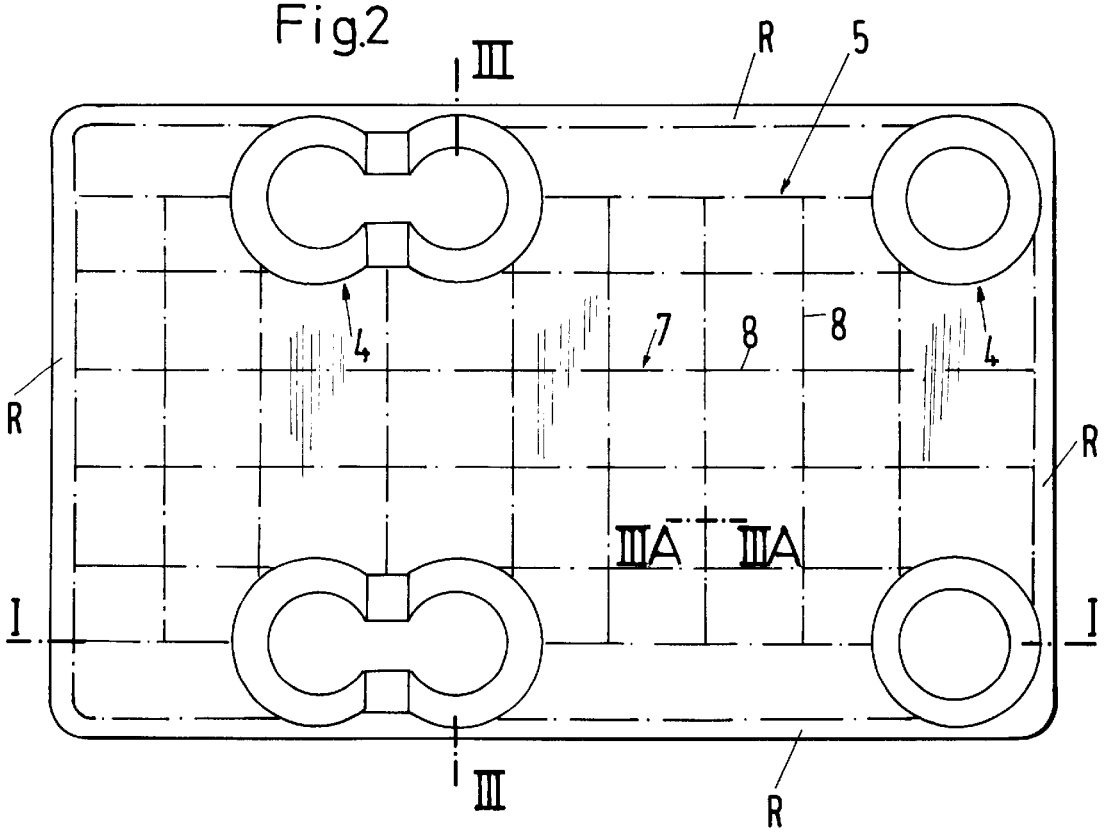
Fig.3
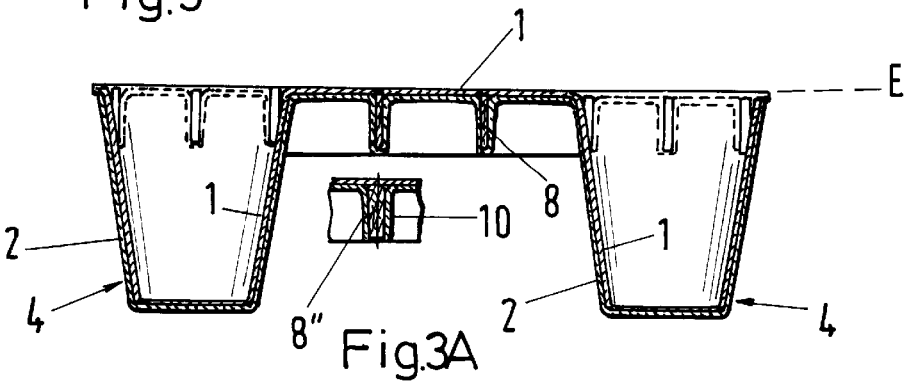
Fig.3A

Fig.11
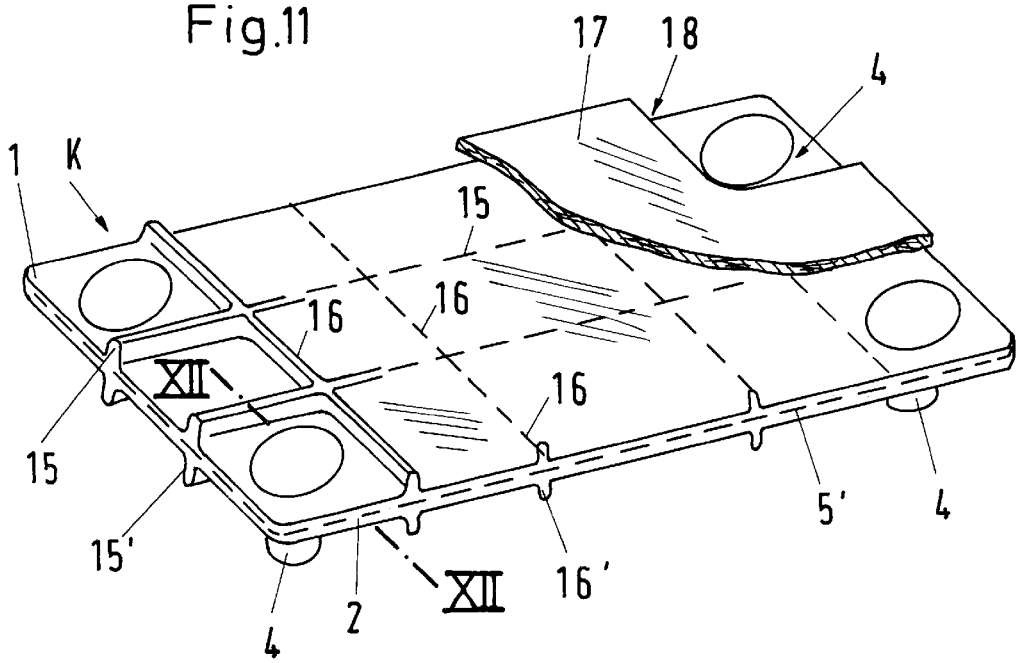
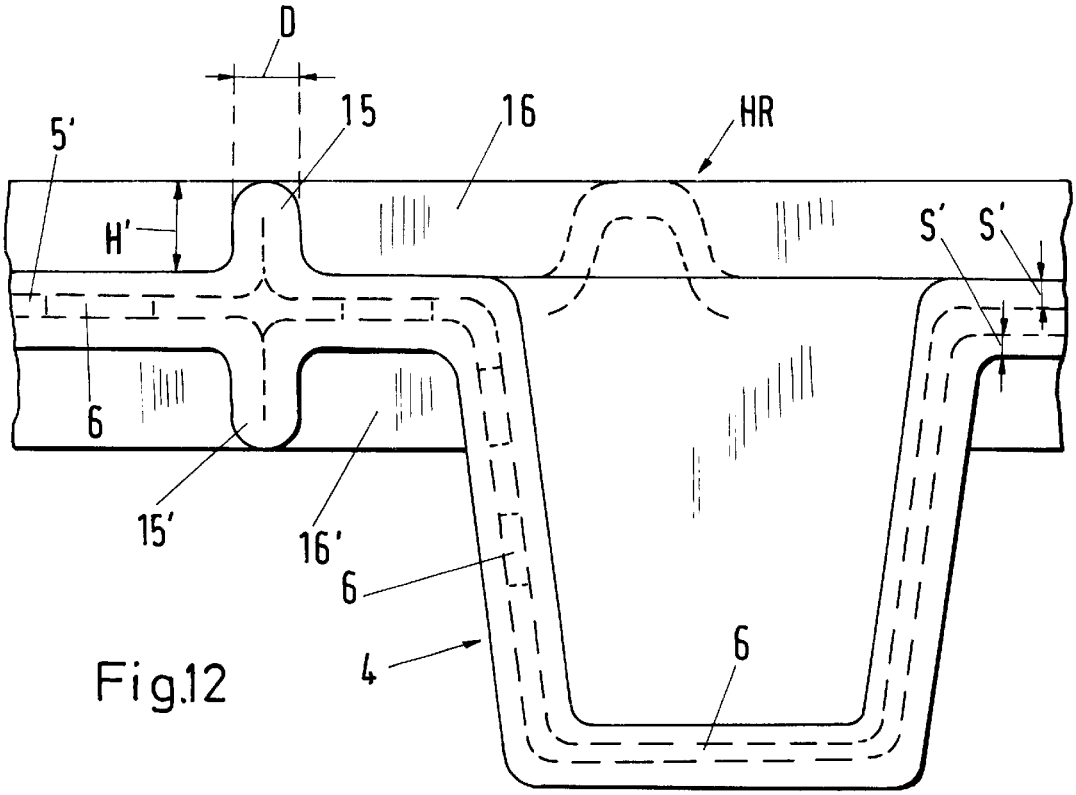
Fig.12

LOAD-CARRYING PALLET

It is the object of the invention to provide a pallet adapted to be manufactured by suction molding which exhibits a high load-carrying capacity, the layers of which despite employment of the suction molding process are firmly interconnected.

This object, in the practice of the invention, is achieved by a pallet comprising a bearing face formed of two layers, with the bearing face being provided with cup-shaped cup-shaped support legs molded on the bottom side of the bearing face and being open toward the same, wherein the bearing face and the cup-shaped support legs are made, by suction molding, of recycling paper, cardboard and/or cellulose fiber waste, it being of decisive importance that provided between the two layers forming the bearing face and the cup-shaped support legs is a reinforced layer equally made of recycling material, with the said reinforced layer being provided with openings distributed across the face, through which upper and lower layer are interconnected by the oppositely directed rough faces.

In this connection, the preferred form of embodiment is the one in which the reinforced layer is a layer formed, by suction molding, of the same material as the upper and lower layers which is provided with openings and molded cup-shaped support legs. Advantageous embodiments reside in that also the walls of the cup-shaped support legs of the reinforced layer are provided with openings, that the material of the reinforced layer is blended with a biologically decomposable binder and reinforcing agent and that the upper and lower layers are provided with transverse and/or longitudinal fins yet to be explained in greater detail hereinafter.

Apart from the preferred form of embodiment of the pallet also other recycling materials can be used for the reinforced layer yet to be explained. However, in this respect it is important for the reinforced layer to be provided with openings through which the upper and lower layers with the oppositely directed rough fibrous faces thereof can be firmly interconnected by felting which process is performed in still wet condition followed by drying.

The present invention is concerned with a load-carrying pallet formed of paper, cardboard and/or cellulose fiber waste.

Dual-layer pallets of the afore-described type are taught, for example, by German Gebrauchsmuster No. 94 13 164 according to which such pallets are manufactured by suction molding. As to the pertinent state of art additional reference is made to the following literature references: German Gebrauchsmuster Nos. 91 00 014 and 73 03 502 and to German Patent No. 29 18 573 C2. Concerning suction molding reference is made to European Patent No. 0 616 076 and to U.S. Pat. No. 867,389.

The individual load-carrying capacity of the pallets according to German Patent No. 29 18 573 C2 and German Gebrauchsmuster Nos. 91 00 014 and 73 03 502, can be left unconsidered. However, the loading capacity of pallets manufactured by suction molding which, basically, is a very advantageous process, is not entirely satisfactory. Admittedly, the pallet according to German Gebrauchsmuster No. 94 13 164 also can be enhanced, for example, by a dual-layer configuration, however, it has proved that the layers cannot be interconnected with adequate firmness. That problem would also be encountered if the molded elements manufactured according to U.S. Pat. No. 867,389 were provided with an intermediate layer enhancing the strength because molded elements produced by suction molding always have one relatively smooth and solid side showing the suction screen structure, and one rough, i.e. fibrous side. It is only the rough sides that can be interconnected with adequate firmness as also taught by U.S. Pat. No. 867,389.

The pallet according to the invention, advantageous embodiments and the manufacture thereof will be described hereinafter in closer detail with reference to the graphical illustration of some forms of embodiments, wherein FIG. 1 is a longitudinal section taken along line I—I in FIG. 2 through one form of embodiment of the pallet;

FIG. 2 is a plan view of the pallet according to FIG. 1;

FIG. 3 a sectional view of the pallet along line III—III in FIG. 2;

FIG. 3A is an enlarged sectional view taken along line IIIA—IIIA in FIG. 2;

Figure 5A:
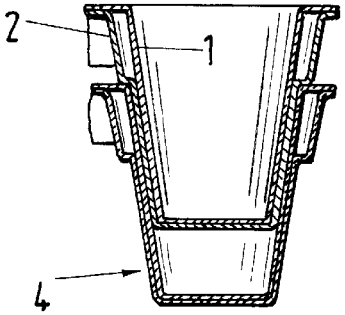
Figure 5B:
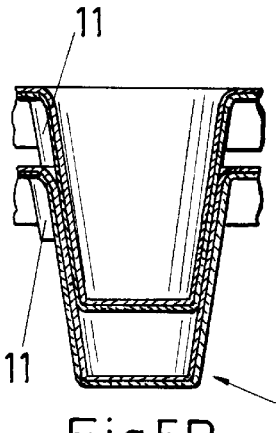
Figure 5C:
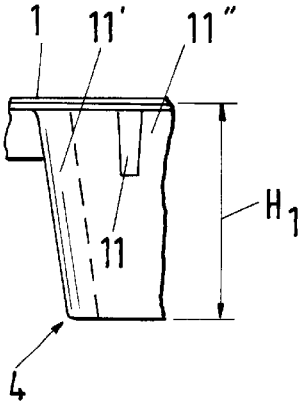
Figure 6A:
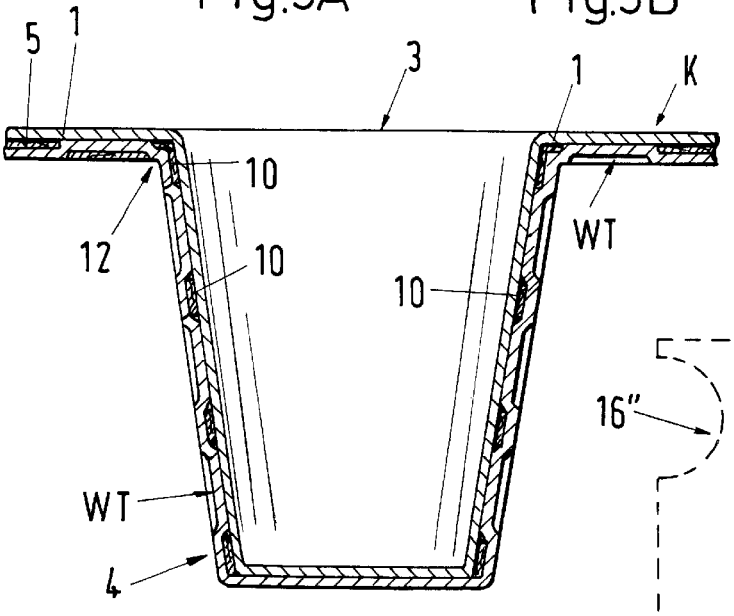
Figure 7:
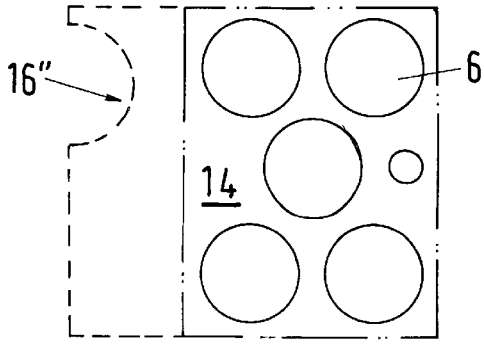
Figure 8:
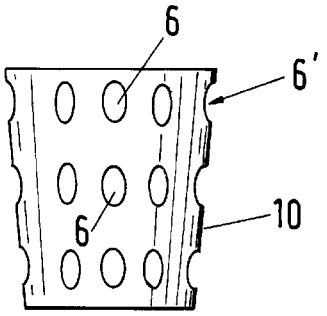
Figure 10A:
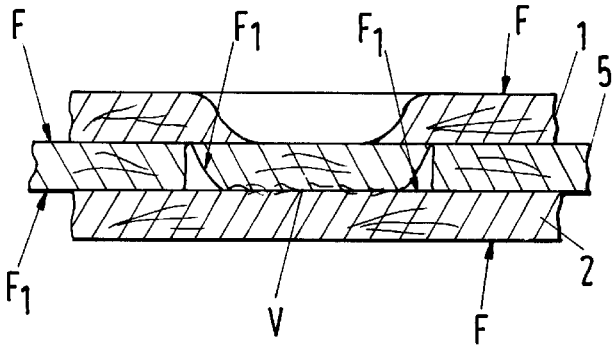
Figure 9:
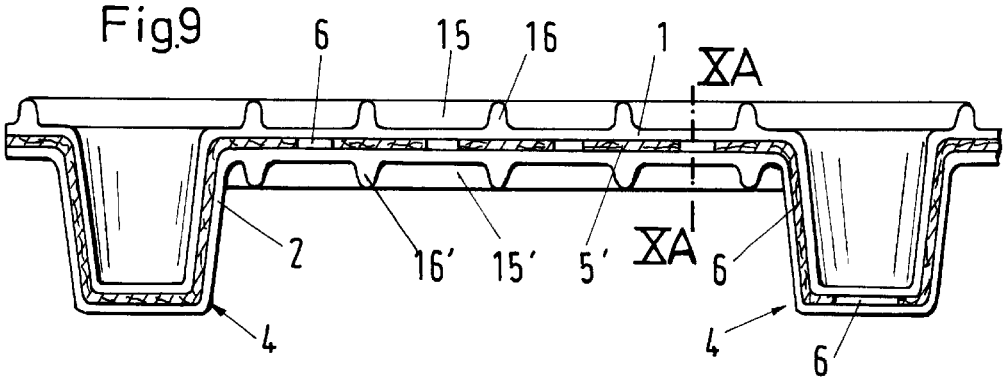
Figure 10:
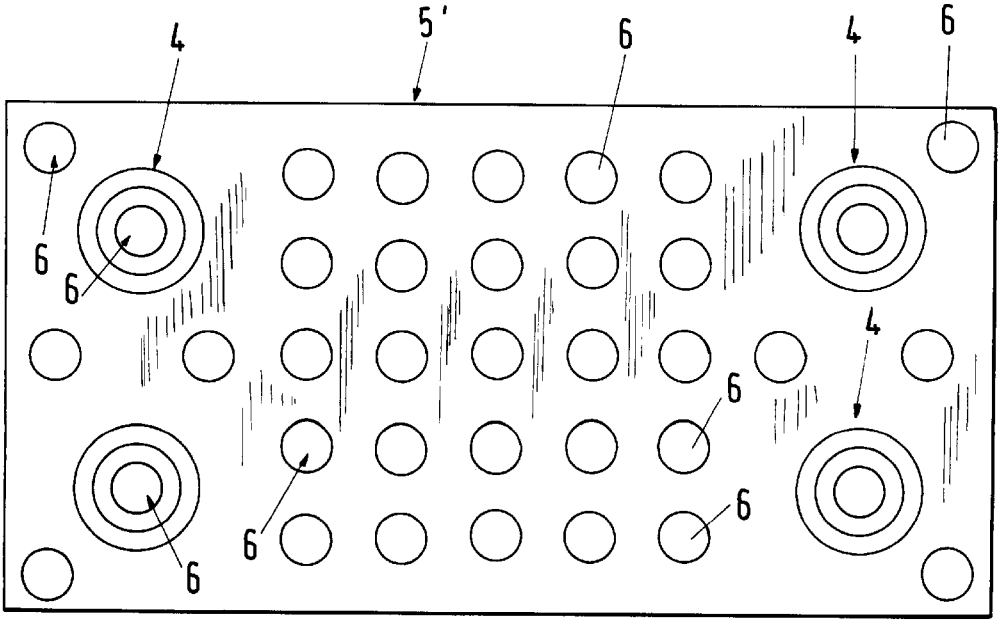
Figure 13:
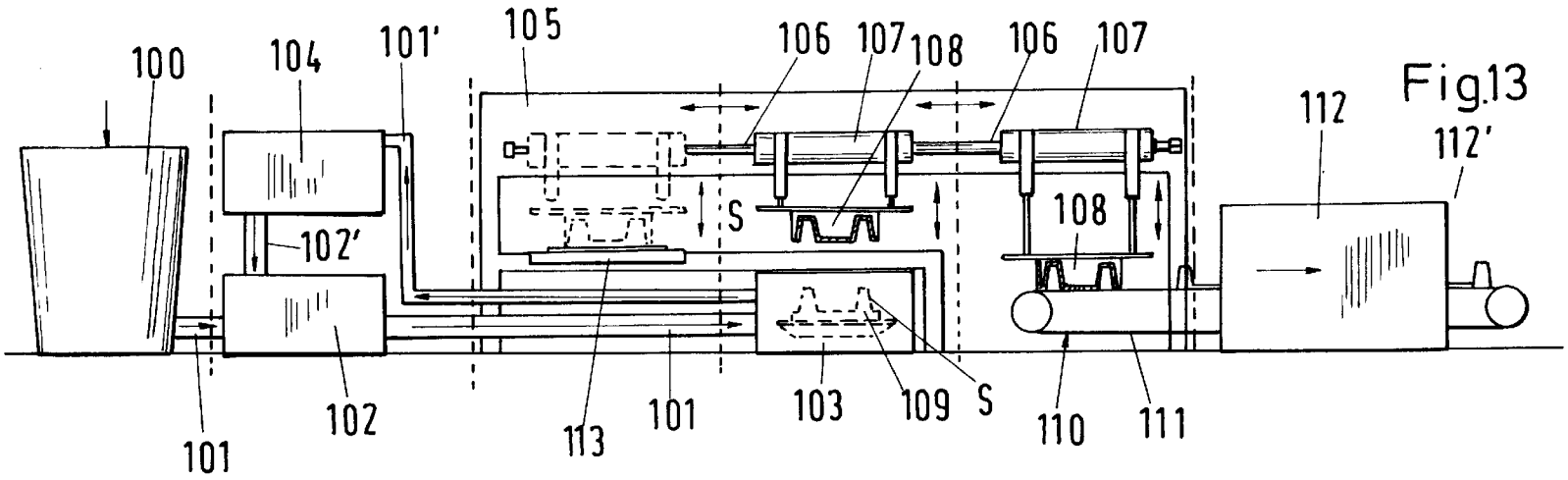
Figure 14:
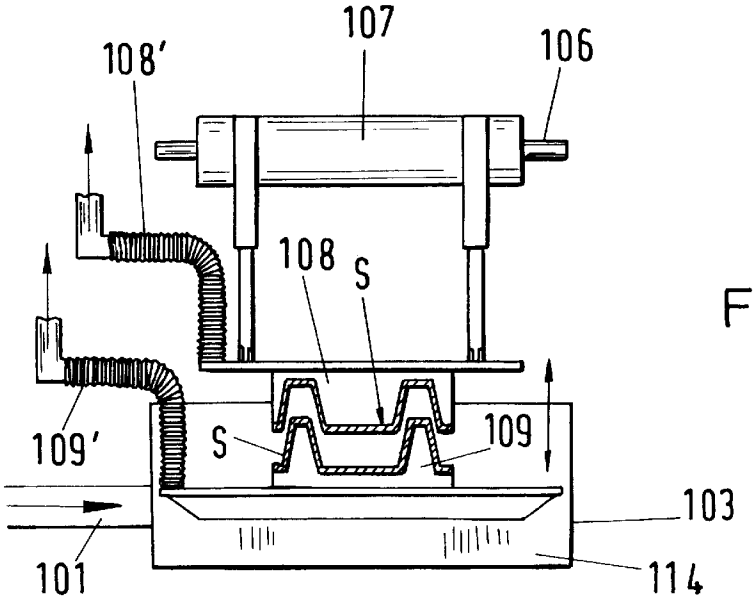
Figure 15:
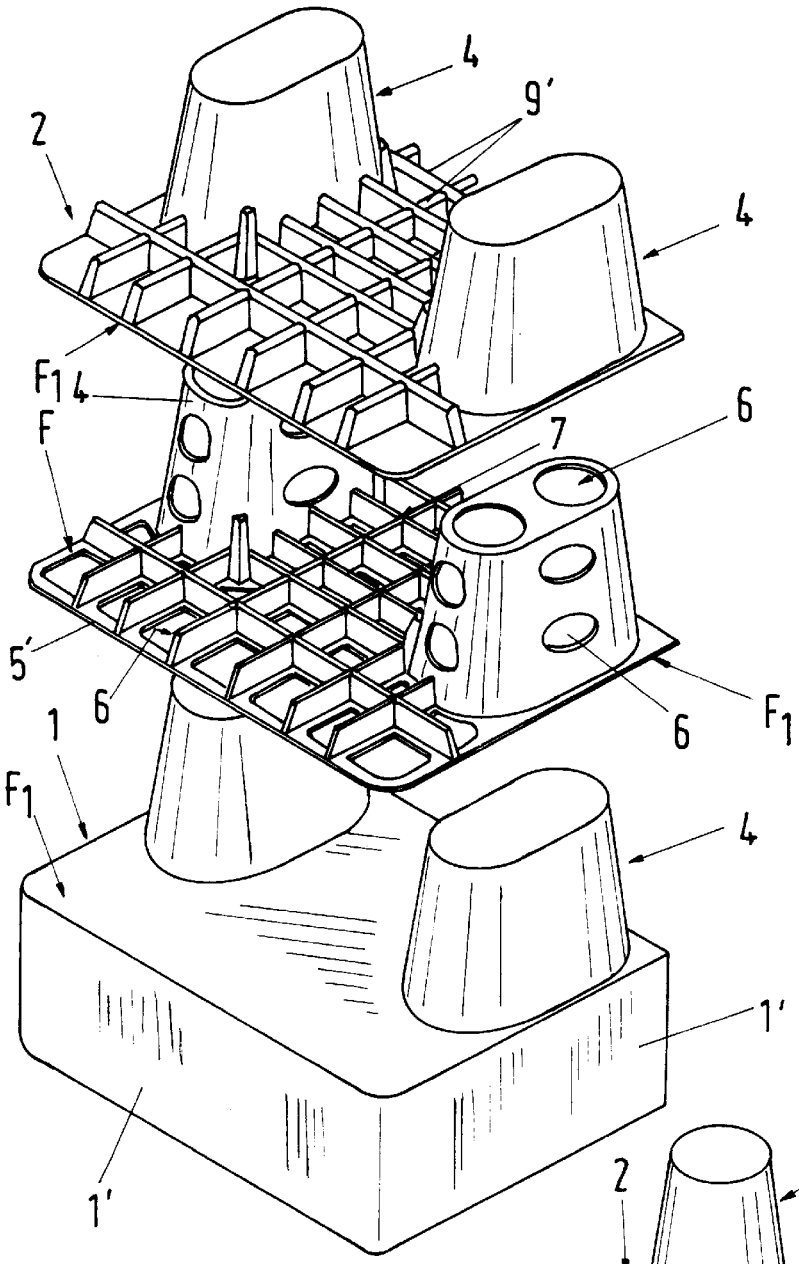
Figure 16:
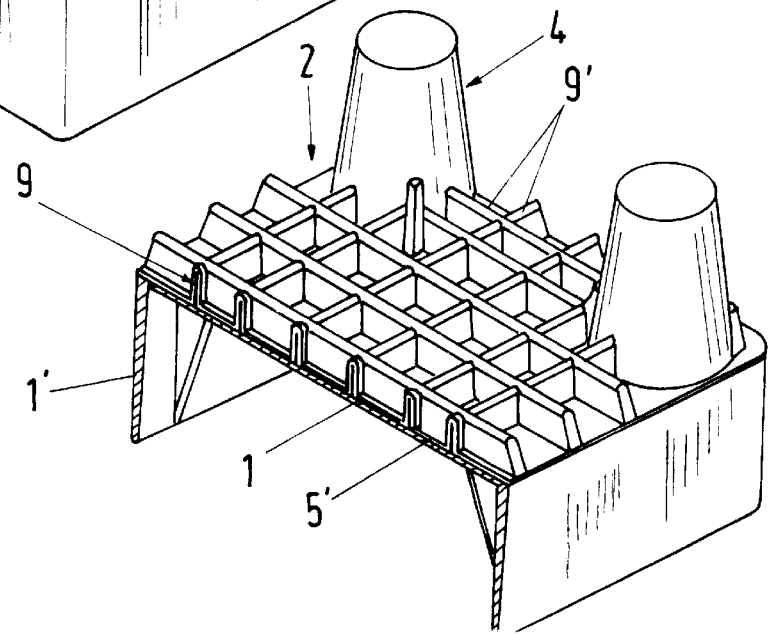

FIG. 5A–C are sectional (A), fragmentary sectional (B) and side (C) views of the cup-shaped support legs of the pallet;

FIGS. 6A,B are sectional views of another embodiment of the pallet;

FIG. 7 is a plan view of a cut from the cardboard blank forming the reinforcing layer;

FIG. 8 is a side and front view of a cardboard blank in the form of a sleeve for the cup-shaped pallet legs according to FIG. 6A;

FIG. 9 is a sectional view of a preferred embodiment of the pallet;

FIG. 10 is a plan view of the reinforcing layer of the pallet according to FIG. 9;

FIG. 10A is an enlarged sectional view of a connection area taken along line XA–XA in FIG. 9;

FIG. 11 is a perspective view of another embodiment of the pallet;

FIG. 12 a sectional view of the pallet taken along line XII—XII in FIG. 11;

FIG. 13 is a side view of a system for manufacturing the pallet;

FIG. 14 is a sectional view, on an enlarged scale, of the dip tank of the system according to FIG. 13;

FIG. 15 is a perspective view of the three layers prior to their being joined together; and FIG. 16 is a perspective view of the three layers according to FIG. 15 after their being joined together.

In the drawings, the faces S of the suction molds 108 and 109 as shown in FIG. 13 and 14 correspond to the molds of layers 1 and 2 forming the pallet as shown in FIGS. 1 to 6B and 9,10. The said layers 1 and 2 are so designed that, on the one hand, they are removable from the suction mold faces S and, on the other hand, they can be nested in one another. The resultant wall depressions WT of the bottom layers 2 are not provided on the suction mold face S of the bottom suction mold 109 but are formed only during compression of the two layers 1 and 2 with the respective reinforcing layer 5. The suction mold process as such does not require any closer explanation as it is basically known, with mold elements (in the present instance: layers 1 and 2) being formed which comprise one substantially smooth side (showing the screen structure of the suctioning mold surface S) and one rough side. Directed with their rough faces against one another, the layers 1 and 2 are also joined together with the reinforcing layer 5 bonded thereinto, i.e. the pallets provided with a reinforcement comprise outer smooth faces.

As to the pallet according to a first form of embodiment, reference is made to FIGS. 1 to 4. It is important for the said pallet that the reinforcing layer 5 is formed of a web grating 7 consisting of webs 8 of rectangular cross-sections oriented with their main axis 8" in a direction normal to the bearing face 3, with female grooves 9 being formed in the bottom layer 2 conforming to the raster of the web grating 7, with the grooves 9, in cross-section, corresponding to the height H and width B of the webs 8 (see FIG. 3).

Figure 4:
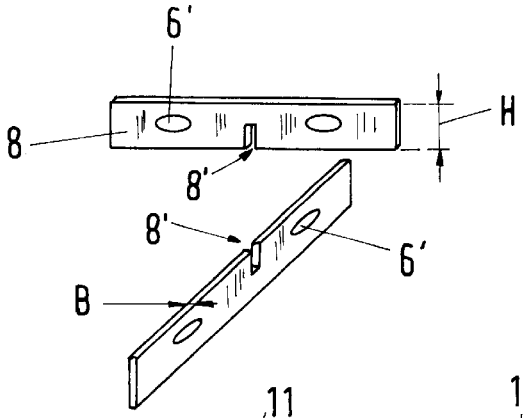
FIG. 4 is a perspective view of two sections of the web grating.

In accordance with FIG. 4, the webs 8 forming the web grating 7 are provided with plug-type slots 8' arranged in the graticule of the grating. The said webs 8 are of a height H of, for example, 25 to 35 mm and a width of, for example, 5 mm; they may also be provided with openings 6'. Also, the webs may be made of, for example hard fiber plate blanks in lieu of cardboard; however, this is not suitable for use with the reinforcing sleeve 10 to be incorporated into the cup-shaped support legs 4 because that material has a limited flexural strength only. To additionally reinforce the cup-shaped support legs 4 against vertical load, it is advantageous to provide the bottom layer 2 in the neck area of the cup-shaped support legs 4 thereof with outwardly directed short hollow fins 11 uniformly distributed along the circumference. As shown in FIG. 5C in broken lines, also inwardly directed hollow fins 11' can be provided which extend throughout the entire height H1. The outwardly directed hollow fins 11 are dimensioned slightly longer than the height H of the webs 8, with the said hollow fins 11 forming mounting stops during stacking of pallets of this type (see FIGS. 5A, B) which facilitates the withdrawal of individual pallets from the stack which, in the absence of such stops, could be too firmly pressed together so that separation thereof would be difficult.

The web grating 7 is shown in dash-dotted lines in FIG. 2; it imparts to the entire pallet a high sagging stability because the individual webs 8 vertically oriented with the main axis thereof in that direction have a high bend resistance moment. Advantageously—as particularly shown in FIG. 3A—two web strips for one grating web each are placed in side-by-side relationship so that the female grooves 9 on the suction mold for the bottom layer 3 are of a larger width, with the required suction pressure being more efficient throughout the face within such a broad groove, apart from the fact that broad grooves of this type can be more easily realized on the suction mold. In the area between the webs 8 and also in the peripheral areas R, the two layers 1,2 with the rough faces thereof are in abutting relationship, with the web grating 7 inserted, which is of decisive importance in order to enable the two layers 1,2 to be felted or bonded together in this area during compression. The free spaces of the web grating 7, hence, in this embodiment form the openings 6.

Figure 6B:
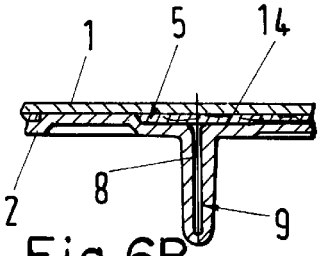

The form of embodiment according to FIGS. 6,7 differs from the one described hereinbefore in that provided in the bearing face 3 between the two layers 1,2 forming the pallet body K, is a blank 14 of cardboard or hard fiber material and that the said blank embraces the necks 12 of the cup-shaped support legs 4 at least in part by recesses 6" (FIG. 7) and is provided with holes or openings in respect of which a diameter of about 20 to 35 mm has proved to be to insure an adequately firm layer connection. Also in that form of embodiment the cup-shaped support legs 4 can be formed—as shown in FIG. 6A (which also applies to the aforedescribed form of embodiment)—with a reinforced sleeve 10 between the layers 1,2. In order to impart to the perforated blank, which due to the fact that it is a planar structure has a lower bending resistance moment than the aforedescribed web grating 7, an identical or approximately identical bend resistance moment, female grooves 9 are provided in the bottom layer 2 engaged by the webs 8 arranged on the blank 14, with the webs 8—as shown in FIG. 6B—being, for example, rectangularly bent cardboard strips suitably connected to the blank (e.g. by clamping or cementing).

The embodiment of FIGS. 9 and 10 is the preferred one. According thereto, the reinforcing layer 5' shown as a plan view in FIG. 10 is a layer formed of the same material as the upper and lower layers 1,2 by suction molding and provided with cup-shaped support legs 4. To impart to the said reinforcing layer a higher strength the material thereof, advantageously, is blended with a biologically decomposable binder and reinforcing agent, such as, for example, wheat or rice starch.

It is of decisive importance for the pallet construction—and this applies to all embodiments—that the compression of the layers 1 and 2, the reinforcing layer 5 included, be performed in wet condition to enable the oppositely directed rough surface areas of the layers 1 and 2 to be firmly felted or hooked together in the openings 6 of the reinforcing layer 5 as shown in FIG. 10A on an enlarged scale. The smooth faces of the layers 1 and 2 only comprising the suction screen structure, and of the reinforcing layer 5 are designated by the letter F, whereas the rough faces are designated by numeral F1 while the connecting area is identified by V. These designations also apply to the embodiment according to FIGS. 11 and 12 in which the reinforcing layer 5 is also manufactured by suction molding. In that embodiment the pallet also comprises the two layers 1,2 to which are molded, in the corner areas thereof, the top-open cup-shaped cup-shaped support legs 4. Moreover, longitudinal and transverse fins 15,16 are provided that cross on the two layers 1,2. The fin structure as shown is by way of example only, i.e. it is possible to provide a substantially larger number of fins more closely associated to one another, it being also possible to provide only selected areas with a closer fin arrangement. Moreover, it is possible for fins to be arranged along the pallet edges. According to a configuration (not shown), the fin structures can be arranged in staggered relationship on the two layers 1,2. If, as shown, the upper layer 1 is provided with such longitudinal and transverse fins 15,16 the same or the pallet can be covered by a cover layer 17 which, in suitable manner, is firmly connected to the pallet, as by cementing, clamping etc. To insure the stackability of such pallets which, as a rule, is required for storage and transport, the cover layer 17 is provided with cuts 18 so that the mounting toes 4 of the next following pallet can engage the openings 19 of the pallet provided therebelow. The relationship of dimension of the sectional view in FIG. 12 approximately corresponds to the factual conditions, i.e. the wall strengths of the layers 1,2 and of the reinforcing layer 5 obtainable by suction molding amount to about 5 to 10 mm. It is of importance that the longitudinal and transverse fins 15,16 and 15'16', respectively, do not form hollow fins HR, as shown, for the sake of comparison only, in FIG. 12, because such fins, even if employable, are not so stable as are the factually provided "solid fins" formed with a corresponding design of the felting screen, i.e. the grooves in the suction screen both in width and in height must be so dimensioned that the grooves, during suction molding, can fill the grooves completely.

The arrangement for manufacturing the preferred embodiment according to FIG. 13 will now be described, numeral 100 designating a suction communication by conduits 101 via a pre-mixing basin 102 with a dip tank 103. Excess water through a conduit 101' is returned to a water tank 104 which through a conduit 102' is in communication with a pre-mixing basin 102. Provided in a rack 105 of the arrangement, above the dip container 103, are guides 106 on which are displaceably guided two holders 107 for upper suction molds 108. The suction molds 108 are fixed to the holders 107 in a manner movable up and down. A bottom suction mold 109 is also arranged within the dip container 103 in a manner movable up and down, with a transfer track 110 being provided therebehind wherein the finished pallets are transferred to a conveyor belt 111 passing through a drying tunnel 112. Located ahead of the dip container 103, within the rack 115 of the arrangement, is a feeder 113 for the reinforcing system 5' according to FIGS. 9 and 10 manufactured in another dip container (not shown) also by suction molding, the suction fluid of which is blended with the afore-mentioned binder.

For molding the upper and lower layers 1,2, the two suction molds 108 and 109 are completely plunged in the suction 114 contained in the dip container 103 but are adequately spaced from one another in order to enable the two layers 1,2 to be molded by felting. During this operation, a reinforcing layer 5 is provided in the supply means 113. After felting and molding of the upper layer 1, the upper suction mold 108 is moved out of the dip container across the supply means 113 and is forced onto the reinforcing layer 5 contained therein, with vacuum being maintained on the suction mold 108. Now, the upper layer 1 and the reinforcing layer 5' drawn in at the same time are returned to a position above the dip container 103, plunged and forced onto the bottom layer 2 which is seated on the bottom suction mold 109. When lifting the three joined-together layers first the vacuum is fully maintained on the bottom suction mold 109 to drain downwardly as much water as possible from the molded element which is now composed of three layers. After removal from the dip tank 103, the vacuum is turned off at the bottom suction mold 109 and the maximum vacuum holds the molded body now composed of three layers on the upper suction mold 108 which with the carrier 107 thereof is displaced into the transfer track 110, deposited or blown onto the conveyor belt 111 and is moved into the drying tunnel 112, leaving the same as a finished pallet on the other end 112'. As shown, two carriers 107 are provided within the arrangement with respectively one upper suction mold 109. The carriers 107 and the suction molds 109, hence, are alternately actuated, i.e. once the upper suction mold 108 with the upper layer 1 formed thereon is above the feeder 113 for the reinforcing layer 5', after a start-up phase in continuous operation, the three layers are joined together within and above the dip container 103. Thereafter, the two carriers 107 are displaced to the right, with the next lower layer 2 being generated on the bottom suction mold 109. During deposition of the finished pallet on the conveyor belt 111, the upper layer 1 and the reinforcing layer 5' are placed onto the bottom layer 2 as described, and the two carriers 107 with the empty upper suction molds 108 are moved back through the transfer means 113 and the dip container 103. The left-hand carrier 107, with the suction mold 108 thereof, hence, takes over and transfers of the reinforcing layer 5', whereas the right-hand carrier 107 with the suction mold 108 thereof moves the three-layer molded element upwardly, conveying it to the transfer track 110 and depositing it on the conveyor belt 111 . Once the two layers 1 and 2 and the reinforcing layer 5' are lifted out of the dip container 103, vacuum is generated in the suction mold 108 through conduit 108', and excess pressure is generated in the suction mold 109 through conduit 109' which involves a compression of the material forming the layers 1,2 and the reinforcing layer 5', with wall impressions designated by WT in FIGS. 6A, 6B and 10A being formed in the area of the openings 6, the depth of which are about 2 to 3 mm. The wall strength of the finished pallet, after leaving the drying tunnel 112, is about 6 to 10 mm.

The sectional view of FIG. 12 shows a pallet section in wet condition. In dried condition the thickness D of the fins 15 and 16 approximately corresponds to the strength S' of the two layers 1 and 2, whereas the height H' is two to four times the thickness D.

FIG. 15, again, is a perspective view of partial areas of the two layers 1 and 2 as well as of the reinforcing layer 5' in wet condition before their being joined together, whereas FIG. 16 shows a part of the pallet in joined-together condition. The upper layer 1 constitutes a special embodiment, as it is provided with a relatively high peripheral edge 1' so that a so formed pallet can also be used for transporting bulk material. Apparently, also the reinforcing layer 5' and the bottom layer 2 may be provided with such peripheral edges 1'. Incidentally, in FIGS. 15 and 16, corresponding parts are provided with corresponding reference numerals. The reinforcing layer 5' is manufactured on the suction molds S so configured that the reinforcing layer 5' integrally includes the afore-described web grating 7 while the lower layer 2 also contains, integrally, a conforming negative structure of hollow fins 9' provided with crossing grooves 9, with the web grating 7 fitting thereinto.

I claim:

1. A suction molded pallet comprising a bearing face and cup-shaped support legs comprised of at least two layers of recyclable cellulose fiber waste, the bearing face and the cup-shaped support leas being comprised of two outer layers and a reinforcing intermediate layer of recyclable cellulose fiber waste, the outer layers having a smooth face and a rough face, the rough faces facing the reinforcing intermediate layer, the reinforcing intermediate layer defining a multiplicity of openings wherethrough one of the outer layers is sucked into contact with the other outer layer, and the rough faces of the outer layers contacting each other through the openings in the reinforcing intermediate layer whereby the contacting rough faces are locked to each other to connect the outer layers to each other.

2. The suction molded pallet of claim 1, wherein the openings in the intermediate reinforcing layer have a total area corresponding to at least half the area of the bearing face.

3. The suction molded pallet of claim 1, wherein the intermediate reinforcing layer is a grating comprised of rectangular webs oriented perpendicularly to the bearing face and defining the openings, a bottom one of the outer layers having grooves receiving the webs, and the webs and grooves having the same height and width.

4. The suction molded pallet of claim 1, wherein the cellulose fiber waste of the intermediate reinforcing layer is bonded by a biologically decomposable binder and stiffening agent.

5. The suction molded pallet of claim 1, wherein the smooth face of at least one of the outer layers has ribs having a thickness of a magnitude of the combined thickness of the two outer layers and a height corresponding to twice to four times the thickness of the ribs.

6. The suction molded pallet of claim 5, wherein the ribs extend in a direction corresponding to a longitudinal extension of the bearing face.

7. The suction molded pallet of claim 5, wherein the ribs extend in a direction transverse to a longitudinal extension of the bearing face.

8. The suction molded pallet of claim 5, wherein the outer layer having the ribs is a top layer, and further comprising a planar covering layer arranged over the ribs of the top layer, the covering layer also being a layer of recyclable cellulose fiber waste.

9. The suction molded pallet of claim 8, wherein the planar covering layer defines cut-outs in alignment with the cup-shaped support legs.

* * * * *